US006574884B1

(12) United States Patent
Jokinen

(10) Patent No.: US 6,574,884 B1
(45) Date of Patent: Jun. 10, 2003

(54) BLOWING APPARATUS IN A PAPER MACHINE OR THE LIKE

(75) Inventor: Reijo Jokinen, Raisio (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/913,915

(22) PCT Filed: Feb. 21, 2000

(86) PCT No.: PCT/FI00/00130

§ 371 (c)(1),
(2), (4) Date: Jan. 17, 2002

(87) PCT Pub. No.: WO00/50693

PCT Pub. Date: Aug. 31, 2000

(30) Foreign Application Priority Data

Feb. 22, 1999 (FI) ..... 990370

(51) Int. Cl.[7] ..... F26B 11/02

(52) U.S. Cl. ..... 34/114; 34/115; 34/116; 34/123

(58) Field of Search ..... 34/454, 455, 456, 34/459, 115, 116, 123, 129, 114

(56) References Cited

U.S. PATENT DOCUMENTS

| | | | | |
|---|---|---|---|---|
| 4,359,827 A | | 11/1982 | Thomas | |
| 4,441,263 A | * | 4/1984 | Vedenpaa | 34/115 |
| 4,669,198 A | | 6/1987 | Wedel | |
| 4,905,380 A | * | 3/1990 | Eskelinen et al. | 34/457 |
| 5,020,242 A | * | 6/1991 | Mayer et al. | 34/115 |
| 5,341,579 A | | 8/1994 | Schiel et al. | |
| 5,515,619 A | * | 5/1996 | Kahl et al. | 34/114 |
| 5,782,009 A | | 7/1998 | Kotitschke | |
| 6,317,999 B1 | * | 11/2001 | Virta et al. | 34/114 |

FOREIGN PATENT DOCUMENTS

| | | |
|---|---|---|
| FI | 65460 | 1/1984 |
| FI | 75892 | 4/1988 |
| FI | 82502 | 11/1990 |
| FI | 94/03675 | 2/1994 |

* cited by examiner

*Primary Examiner*—Ira S. Lazarus
*Assistant Examiner*—Kathryn S. O'Malley
(74) *Attorney, Agent, or Firm*—Lathrop & Clark LLP

(57) ABSTRACT

The blowing device comprises a blow box (30) which is arranged at the opening nip (22) between the wire and the cylinder and which is provided with at least two nozzles (36; 44, 46) or the like arranged close to the wire or the like. The first nozzle (36) is arranged at the opening nip (22) between the wire and the cylinder, for blowing air away from the gap (34) between the wire and the blowing device. The second nozzle (44, 46) is arranged at a distance from said opening nip, in the wire travel direction. The air jets discharged from the nozzles maintain a negative pressure in the space between the blowing device and the wire. In the blowing device, at a short distance from the opening nip, there is further arranged a throttling means (50) projecting toward the wire, the throttling means dividing the negative pressure space formed between the first nozzle and the second nozzle into an intensified negative pressure region (34') bordering to the location of the opening nip and into a second lower negative pressure region (34", 20').

21 Claims, 10 Drawing Sheets

BLOWING APPARATUS IN A PAPER MACHINE OR THE LIKE

The present invention relates to a blowing device according to the preamble of the claim 1 presented below, in a paper machine or the like, such as in a paperboard or a finishing machine or in another web treatment machine.

The invention is particularly intended to be applied in the drying sections of paper, paperboard or finishing machines or the like. The intention is then to be able to apply the invention in drying sections provided with a single wire or a twin wire run, where a wire pocket is formed between two drying cylinders and a roll below them which redirects the wire travel. An intention is also to be able to apply the invention in drying sections provided with a so called inverted run, i.e. in such drying sections where the roll turning the wire travel is arranged above the drying cylinders, or in solutions where drying cylinders are arranged above each other on two or more levels. Further the intention is to be able to apply the invention in drying sections provided with combinations of the above mentioned drying sections. The intention is further to be able to apply the invention in suitable respects in other parts of the above mentioned machines.

Previously it has been noted that the need for a negative pressure in the wire pocket is high particularly at the opening gap between the drying cylinder and the wire, so that it is possible to ensure that the wire comes off from the surface of the drying cylinder. However, an increase of the negative pressure in the whole pocket to the required negative pressure level causes certain disadvantages. Large amounts of energy must be used when the whole pocket space must be brought to the same high negative pressure level. Large air leaks may make it impossible to reach a sufficiently high negative pressure and to maintain it. So far it has generally been possible to have a sufficient increase in the negative pressure with the aid of blow boxes.

The object of the invention is typically a blowing device in a drying section which is provided with a single wire run where the web is transported between the wire and the drying cylinder over the drying cylinder. The blowing device comprises a blow box or a blow box combination extending over the whole width of the web, and the device is intended to ensure that the wire comes off from the drying cylinder in the opening nip of the wire in order to keep the web in a controlled way attached to the wire over a desired distance, even after the opening nip.

The blowing device is typically combined with means generating blowing air and arranged on that side of the wire which is away from the cylinder, mainly at the opening nip between the wire and the cylinder so that it extends, from the actual point where the wire and cylinder are disengaged, a short distance forward in the travel direction of the web. The blowing device is typically provided with two nozzles, such as gap nozzles, ejecting nozzles or the like, arranged crosswise regarding the travel direction of the web and close to wire. The first nozzle is arranged mainly at the opening nip between the wire and the cylinder, however preferably before the actual point where the wire is disengaged from the cylinder. The second nozzle is arranged, in the travel direction of the web, at a distance from the first nozzle and the opening nip.

The nozzles are arranged in the blowing device to blow air jets away from the gap between the blowing device and the wire, so that the air jets discharged from the nozzles prevent air from entering the gap and/or suck with their ejection effect air away from the gap between the blowing device and the wire, and thus negative pressure required to support the web is maintained in the gap.

The travel of the web in the opening nip between the drying cylinder and the wire will be the more difficult to control the more the speeds of the paper machine will increase, because when the speeds increase the web will all the more tend to follow the drying cylinder. A speed increase of a few hundred meters may require a doubled negative pressure level, e.g. from a negative pressure of 500 Pa to a negative pressure of 1000 Pa.

The dry solids content of the web has also an effect on how the web comes off from the cylinder. The higher moisture the web has the more difficult it is to disengage it from the drying cylinder and the more difficult it is to achieve a good runability. A dry web will so to speak burn to the surface of the hot drying cylinder, the more easily the higher the temperature of the cylinder is. Therefore the detachment of the web from the cylinder and supporting it on the wire requires higher and higher negative pressures when the production is made more effective and the speeds are increased.

For the time being it has generally been possible to obtain a sufficiently increased negative pressure with the blow boxes. However, when the speeds increase further we get into a situation where it is cumbersome and expensive to further increase the negative pressure.

The need for the negative pressure is different in different parts of the wire pocket formed between the drying cylinders. The highest negative pressure is required at the opening nip between the cylinder and the wire for disengagement the web from the cylinder and for attaching it to the wire. In other parts of the pocket a lower negative pressure would generally be sufficient. However, with present blow box techniques we have to maintain the same negative pressure in the pockets between the drying cylinders, in the whole region over which the effect of the blow boxes extends. Large air leaks to the pocket with the negative pressure cause, particularly in fast machines, difficulties in reaching and maintaining such a particularly high negative pressure which is required at the opening nip mentioned above. Large amounts of energy must be used when the whole large pocket space must be brought to the same high negative pressure level.

Further, increasing the whole negative pressure of the pocket to a high negative pressure level may cause disadvantages. A high negative pressure may on long wire runs bend the wire, which then can come to touch surfaces of the blow box or other inflexible surfaces, and thus cause wire damages and impair the runability. A too high negative pressure in the whole pocket region can also have an effect on the web itself, and it may e.g. prevent the shrinking of the web in the cross direction too much, whereby the web may even split.

An aim is to make the travel of the web in the opening gap between the drying cylinder and the wire more secure by increasing the tension of the paper web. Tension means that a a speed difference is used to create tension in the web. However, an increased tension is not always possible, because a too high tension would decrease the tensile strength of the pare, impair the paper quality, often impair the runability and create more web breaks.

The respective negative pressure required at the paper machine in the opening nip between the drying cylinder and the web, and also in other parts of the pocket space, depends on many factors, both on production parameters and on the paper quality being produced. The requirements on the negative pressure are affected i.a. by the machine speed, the dry solid contents of the paper, the paper profile after the press, the paper quality, the paper grammage, tension differences between the press and the drying section, generally the chemistry of the wet end, the operation of the press, and the geometry and structure of the wet end. It should be possible to control the negative pressure when any of these parameters changes. It should be possible to control the negative pressure separately in the opening nip and in other regions with negative pressure.

Previously it has also been proposed to arrange a special suction box at the opening gap between the cylinder and the wire to create a higher negative pressure. The American patent publication U.S. Pat. No. 5,341,579 proposes to arrange a particular small suction box at the opening gap, with which a certain negative pressure is maintained at this point. The negative pressure at this suction box 20 and at the suction roll 12 is generated by a negative pressure blower 32. Thus they can not be controlled separately.

The American patent publication U.S. Pat. No. 5,782,009 presents a suction box mounted in the pocket between two drying cylinders, whereby the suction box is divided into two parts. The suction box part 1 having a higher negative pressure is arranged in the region of the disengaging point between the drying cylinder and the wire. The region is separated from the environment with the aid of mechanical seals. In the cross direction of the web the part 1 with the higher negative pressure can be divided into several parts, where differing negative pressures can be created in order to secure the travel of the edges of the web.

The American patent publication U.S. Pat. No. 4,359,827 presents a multi-section suction box arranged in the pocket formed between two drying cylinders. One part of the suction box is arranged in front of the wire, regarding the travelling direction of the wire at the first drying cylinder, before the disengaging point between the wire and the drying cylinder. A higher negative pressure is arranged in this section of the suction box than in the other sections of the suction box which border on the wire.

Thus, the object of the present invention is to provide an improved blowing device where the above mentioned disadvantages are minimised.

The object is particularly to provide a blowing device which makes it possible to generate a higher negative pressure at the opening nip than in other pocket regions with negative pressure.

Then the object is, for instance, to provide a blowing device with which in a drying section provided with a single wire run the negative pressure region of the pocket between the drying cylinders can be divided into two or more separately controlled regions with negative pressure.

Then the object is also to provide a blowing device with which at the opening nip the negative pressure can be controlled independently of other negative pressure control.

An object is also to provide a blowing device, to which it is possible to combine, when required, additional suction and/or blow at the opening nip.

In order to attain the above mentioned objects the invention is characterised in what is defined in the characterising clause of the first claim presented below.

A typical blowing device according to the invention comprises a blow box, in which on the side of the opening nip a throttling means, such as a blowing means or a sealing means, is arranged, in addition to the first nozzle, at a short distance from the actual disengaging point between the wire and the drying cylinder after this disengaging point. The throttling means divides the negative pressure space provided by the blowing device into two sections, a first intensified negative pressure region bordering at the opening nip, and a second smaller negative pressure region.

For instance in a drying section provided with a single wire run a relatively small intensified negative pressure region, at least partly isolated from the other negative pressure region, is provided with the throttling means according to the invention at the nip opening toward the pocket between the drying cylinders where the greatest need for negative pressure exists.

A typical blow box used in a drying section provided with single wire run, Uno Run Blow Box, comprises basically only a narrow box structure occupying only a part of the pocket, whereby the blow box is arranged in front of the wire run between the first drying cylinder and the turn roll. This negative pressure region is typically bordering at nozzles arranged at the top and bottom ends of the blow box, the nozzles ejecting air away from the gap-like space between the wire and the box. According to the invention a throttling means is arranged in the box between the above mentioned nozzles, so that the throttling means divides the negative pressure region generated by the box into two sections and prevents, or at least restricts, the free flow of air between these sections. The throttling means can be a simple mechanical seal which restricts the flow, or a third nozzle which is arranged to eject air away from the upper negative pressure region and to generate an intensified negative pressure region in this region. Generally it could be said that a throttling means is intended to mean all such mechanical throttling means or means provided by a nozzle that restrict the air passage between two regions being at different pressure levels. Thus the throttling means may be e.g. an ejecting nozzle, a flow restricting valve, or a curved wall projecting across the air channel which wall restricts the air flow in the channel.

If the throttling means at the border of the intensified negative pressure region is simply a mechanical, mainly non-adjustable seal, then the negative pressure in the intensified negative pressure region can be controlled for instance by adjusting the air flow of the first ejecting nozzle. The negative pressure in the intensified negative pressure region can be increased or decreased with the aid of the control. Due to the throttling means the control does not have any substantial effect in other parts of the negative pressure region.

On the other hand, if the throttling means is an ejecting nozzle the negative pressure in the intensified negative pressure region can also be controlled by controlling the air flow of this ejecting nozzle. The air which is removed by the throttling means from the intensified negative pressure region can be allowed to flow into other parts of the negative pressure region, because this amount of air is generally small compared to the size of the negative pressure region, or this removed air can be guided immediately after the nozzle completely away from the negative pressure region with the aid of guide plates or discharge channels.

Another typical blow box, Sym Run Blow Box, used in a drying section provided with a single wire run fills mainly completely the pocket defined by the input wire run, the turn roll and the output wire run, and formed between two adjacent drying cylinders. The negative pressure region is typically sealed with nozzles arranged at the front end of the blow box, i.e. mainly at the opening nip of the first drying cylinder and the wire, and at the output end of the blow box, i.e. mainly at the closing nip of the second drying cylinder and the wire. The nozzles are arranged to blow air jets outward from the negative pressure gap, so that the air jets prevent air from leaking inward to the negative pressure space. The nozzles can be so called ejecting nozzles which at the same time remove air from the negative pressure space.

According to the invention a throttling means is further arranged in the box in the region of the wire run between the first drying cylinder and the turn roll, whereby the throttling means isolates a section of the negative pressure region of the pocket into a region with an intensified negative pressure. As described above, this throttling means can be e.g. a mechanical seal or an ejecting nozzle which restricts the flow.

The separate sub-region with an intensified negative pressure according to the invention can also be provided in other negative pressure regions of the most various types, which can be generated with blowing devices. The blowing device can be a blow box, which covers a part of a wire run in a drying section provided with single or twin wire run, or which e.g. in a paper machine covers another wire run or felt run where the web is disengaged from a roll and/or is kept attached to the wire with the aid of a negative pressure, and where a smaller negative pressure region provided with an intensified negative pressure is required in addition to the conventional negative pressure.

The intensified negative pressure region is typically arranged to cover the wire run at the opening nip of a cylinder, so that the intensified negative pressure region begins at a short distance before the actual disengaging point between the cylinder and the wire, and extends a required distance forwards from the disengaging point. The greatest need for negative pressure exists particularly at the disengaging point. During the run the disengaging point may move forward or backward, so the blow box must be arranged so that the provision of a sufficient negative pressure is guaranteed during all running conditions.

In the solution according to the invention a negative pressure is maintained in the intensified negative pressure region which is typically >500 Pa, more generally ≧1,000 Pa, but however ≦20,000 Pa, preferably <10,000 Pa, depending on the running situation. When required, it is of course possible to increase or decrease the negative pressure from the above mentioned values. However, the negative pressure level is typically e.g. higher than the negative pressure $p_{roll}$ which prevails at the surface of the roll which redirects the travel of the web. In other parts of the wire pocket the negative pressure level is considerably lower, i.e. at a level of about 10 to 700 Pa, preferably 100 to 500 Pa, typically 200 to 300 Pa.

In a drying section provided with single wire run the intensified negative pressure region is a region at the opening nip with a length of about 50 to 500 mm, typically 100 to 200 mm. Then the intensified negative pressure region at cylinders nowadays in common use may start already 300 mm, often 40 to 150 mm, typically about 70 mm before the disengaging point of the wire, and it may extend about 40 to 250 mm, often 80 to 120 mm, e.g. 100 mm forwards from the disengaging point during operation. The length of the intensified negative pressure region means the distance in the travel direction of the web between two means, such as seals, throttling means, blow nozzles, which extend from the box close to the web. Between the means a higher negative pressure in the pocket space is created than in the spaces adjacent to this region.

It is, of course, possible to use a plurality of throttling means, such as e.g. mechanical seals, flow barrier plates or ejecting nozzles, to divide the negative pressure region between the box and the wire run into more than two different regions. There can be several consecutive negative pressure regions with staggered negative pressures.

The actual blowing device can comprise a single, simple box structure, or it can be formed by a plurality of structural box components. Between the structural box components there can be formed e.g. air channels in order to convey air away from a negative pressure region to another region or into the environment.

The nozzles generating the negative pressure can be simple gap nozzles which are arranged so that the air flowing out from them prevents air to penetrate into the negative pressure region and/or generates an ejecting effect at a desired point between the box and the wire. Particular ejecting nozzles can be advantageously used in the blow boxes, the nozzles being resiliently or pivotally mounted ejecting nozzles which, when required, move flexibly away from the wire, when e.g. a paper lump pushes the wire against the nozzle, so that they do not break the wire.

In order to guide air away from the intensified negative pressure region the solution according to the invention uses advantageously such surfaces which are convex and which utilising the Coanda effect can controllably direct air into a desired direction, even outside the intensified negative pressure region. With surfaces utilising the Coanda effect it is possible to direct the air, which is discharged from the intensified negative pressure region, in the lower negative pressure region toward the air discharge opening or even into the discharge opening, from which opening the air further can be discharged into a desired space by ejection or by utilising suction.

The negative pressure generated with the solution according to the invention in the intensified negative pressure region can be further intensified by arranging means creating suction in this region. The suction can be created by forming a suction opening which opens up into the blow box in this intensified negative pressure region, the suction opening communicating e.g. via a suction channel with devices creating the suction.

With the means, which are arranged in the blow box and which create suction, it is possible to control the negative pressure level in a simple way. Then the ejection blow nozzles of the box must not necessarily be controlled individually, and they can be connected to common means creating the blow.

Suction is advantageously used, particularly when the throttling means is a mechanical limiting means, which itself does not actively and in a controllable way increase the negative pressure. However, the suction can be used as an addition and to control the negative pressure also in other cases. It is advantageous to arrange a net or a corresponding device in front of the suction opening, to prevent paper lint coming into the negative pressure region from reaching the suction channels.

In contrast to the case with suction boxes, the box and wire do not come into mutual contact when suction is used in connection with the blow box solution according to the invention, where air is blown at the means defining the intensified negative pressure region between the wire and the box.

The invention is described in more detail below with reference to the enclosed drawings, in which FIG. 1 shows a vertical cross section of a pocket between two drying cylinders in a drying section of a paper machine provided with a single wire run, in which pocket a blow box according to the invention is arranged;

Figure 1:
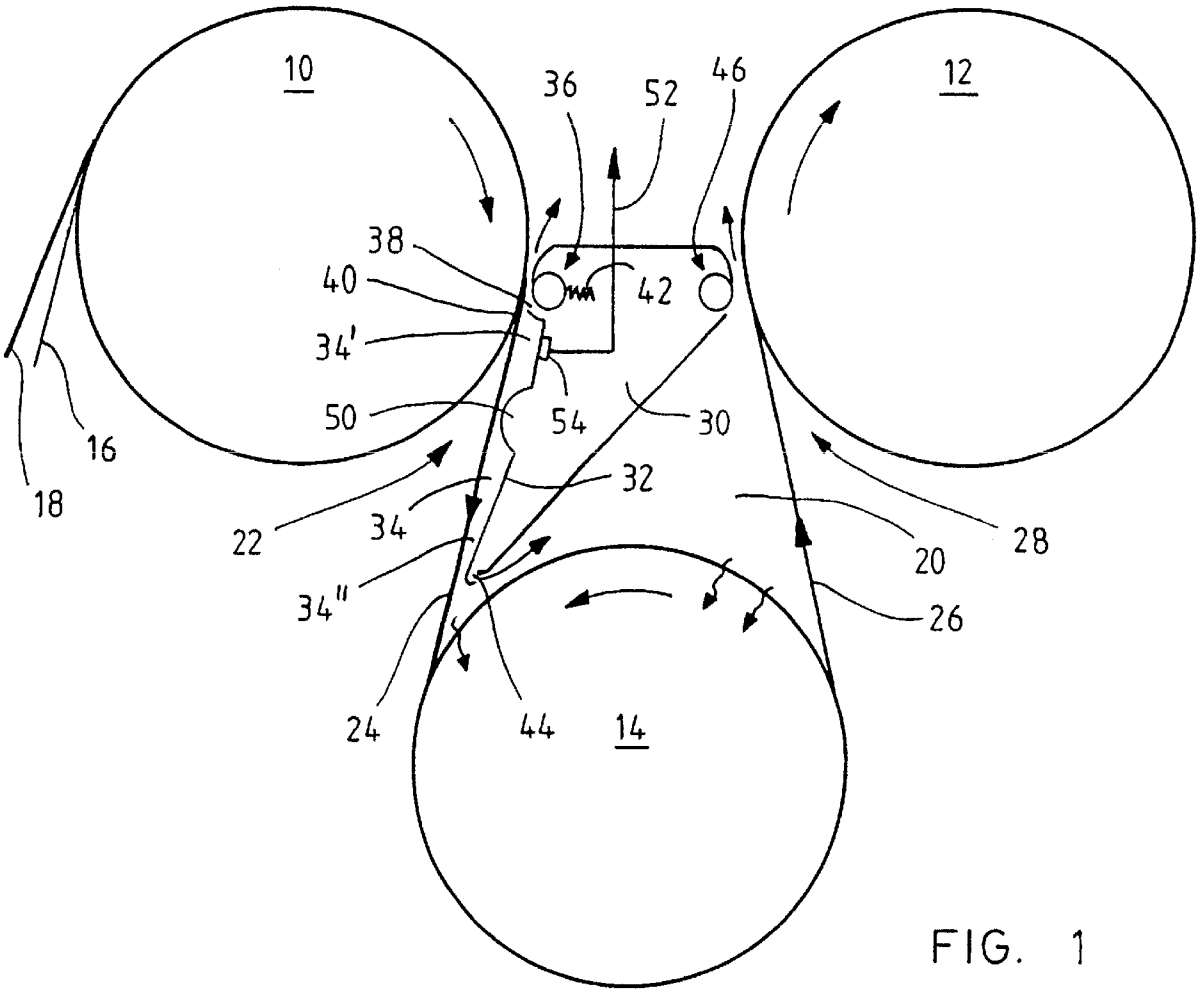

FIG. 1 shows, in a paper machine or the like, two consecutive cylinders or rolls, typically drying cylinders 10 and 12, and a turn roll 14 arranged between the cylinders. The turn roll can be a cylinder, a smooth roll, or a grooved roll. The roll may be perforated, whereby the holes of the roll are connected to a negative pressure source. In the solution according to FIG. 1 the intensified negative pressure is typically created via the peripheral sector adjacent to the pocket space in the roll. The suction of the roll is generated via the axis at its end.

The paper web 16 is arranged to run in a winding manner supported by the wire 18, alternately over a cylinder 10, 12 and alternately over the turn roll 14, so that it forms a pocket 20 between two cylinders and a turn roll.

The wire 18 is disengaged from the periphery of the first cylinder 10 in the so called opening nip 22 and runs to the turn roll 14 so that it forms a so called input wire run 24 between the first cylinder and the turn roll. Correspondingly, the wire runs from the turn roll as a so called output wire run 26 toward the second drying cylinder 12 and passes in the closing nip 28 to run over the second drying cylinder.

The blow box 30 extending over the web is mounted in the pocket 20 so that one of its sides 32 together with the input wire run 24 forms a relatively narrow gap 34, in which the blow box creates a negative pressure. In the upper part of the side 32 of the blow box there is arranged a blowing nozzle 36 which projects from the box 30 toward the wire 18, however without touching the wire. The blowing nozzle 36 is arranged in the box above the opening nip 22, i.e. so that air is discharged from the gap nozzle 38 of the nozzle mainly against the travel direction of the wire, and so that the air is discharged at a point which is above the actual disengaging point between the wire 18 and the cylinder 10, i.e. before the disengaging point in relation to the wire travel direction. The air discharged from the nozzle 36 prevents air travelling with the wire from entering the gap 34 between the box 30 and the wire, and further it ejects away air from the gap so that it creates negative pressure in the gap. The nozzle 36 is fastened to the box with the aid of a spring 42 which pushes the nozzle in a suitable way toward the wire, however so that it enables the nozzle to be pushed into the box, for instance when a paper lump passes the nozzle between the wire and the cylinder.

At the other end of the blow box 30, at its lower end, there is formed a second nozzle, a simple gap-like nozzle 44, having air jets which are directed against the rotation direction of the turn roll and which thus prevent air from passing with the turn roll toward the closing nip between this roll 14 and the wire 18. The blows of the nozzle can also eject air away from the gap between the box and the wire. In many drying sections a suction roll, for instance a VAC roll of the applicant, is used as the turn roll which in the manner shown by the arrows sucks air from the pocket region.

Further, a second ejecting nozzle 46 is arranged in the blow box 30 close to the closing nip 28 of the second cylinder 12, slightly after the closing nip, i.e. at a point where the wire already has engaged to the cylinder. The air jets of this second nozzle are directed away from the pocket, so that they are mainly in the direction of the wire travel. The air jets prevent air from entering the pocket through the gap between the nozzle and the wire. In this way a negative pressure can be maintained in the whole pocket.

According to the invention a throttling means 50 is arranged in the blow box at a short distance from the first nozzle 36, the throttling means dividing the gap 34 between the box 30 and the wire 18 into two sections, the section 34' having an intensified negative pressure and the section 34" having a lower negative pressure. In this case the throttling means is a mechanical seal which prevents, or at least reduces, the air flow from the section 34" to the section 34'. The ejecting nozzle 36 is thus arranged to remove air mainly from a relatively small section of the pocket 20, whereby it is relatively easy to generate even a very high negative pressure in this small section 34', compared to the negative pressure in the other parts of the pocket. With the throttle 50 it is possible to increase the negative pressure level by up to about 200–500 Pa, in some cases even many times more.

The intensified negative pressure in the section 34' assists in disengagement the web from the surface of the cylinder 10, mainly in the disengaging point 40, and to attach the web firmly on the wire. The lower negative pressure in the section 34" is sufficient to keep the web attached to the wire until the turn roll. Suction is typically arranged in the turn roll in order to keep the web attached to the surface of the turn roll. The suction also affects the pocket. The second ejecting nozzle 46 seals the gap between the box and the second drying cylinder and ensures the negative pressure in the pocket as well as that the web does not form a pouch in the closing nip 28.

In the solution according to the invention a relatively low negative pressure, e.g. 100 to 200 Pa negative pressure, may be sufficient in other parts of the pocket, except in the gap 34'. A low negative pressure allows for instance that the elongation of the web can spread over a large area and thus reduce wrinkling of the web.

For the blowing nozzles in the box 30 there may be arranged a common blowing air supply, or an air supply which is individually controlled at each nozzle. When e.g. the nozzle 36 has its own supply the intensified negative pressure level can be separately controlled with this nozzle.

In the solution according to the invention it is further possible to form between the nozzle 36 and the throttling means 50 a suction opening 54 connected to the suction channel 52, such as a gap extending over the whole web with which more air can be removed from the intensified negative pressure region through the gap 34' when required. In front of the suction opening there is advantageously arranged a net or the like which prevents paper lint or other rubbish from reaching the suction channel. The suction channel can be formed so that when a web break occurs it can be connected to a blower in order to blow air into the gap 34' in order to clean the gap.

In the case presented in FIG. 1 it is thus possible to increase the negative pressure at the wire disengaging point 40 by isolating the gap between the wire and the box in this region from the other regions having a lower negative pressure. A resilient throttling means or a throttling means fastened resiliently to the box can be arranged in the box so that it projects very close to the wire, about 2 to 40 mm, typically <20 mm, advantageously <10 mm from the wire (support fabric), and thus effectively separates the negative pressure region 34' from the rest of the surrounding space. When, in addition, the distance of the nozzle 36 from the wire is short and the air jets from this nozzle are sufficient, a negative pressure is obtained at the opening nip which is sufficient for many running requirements, without any further actions. In other parts of the pocket it is then possible to keep the negative pressure at a lower value, which is sufficient for these regions. In this way wire bending is avoided, and the runability is improved.

Figure 2:
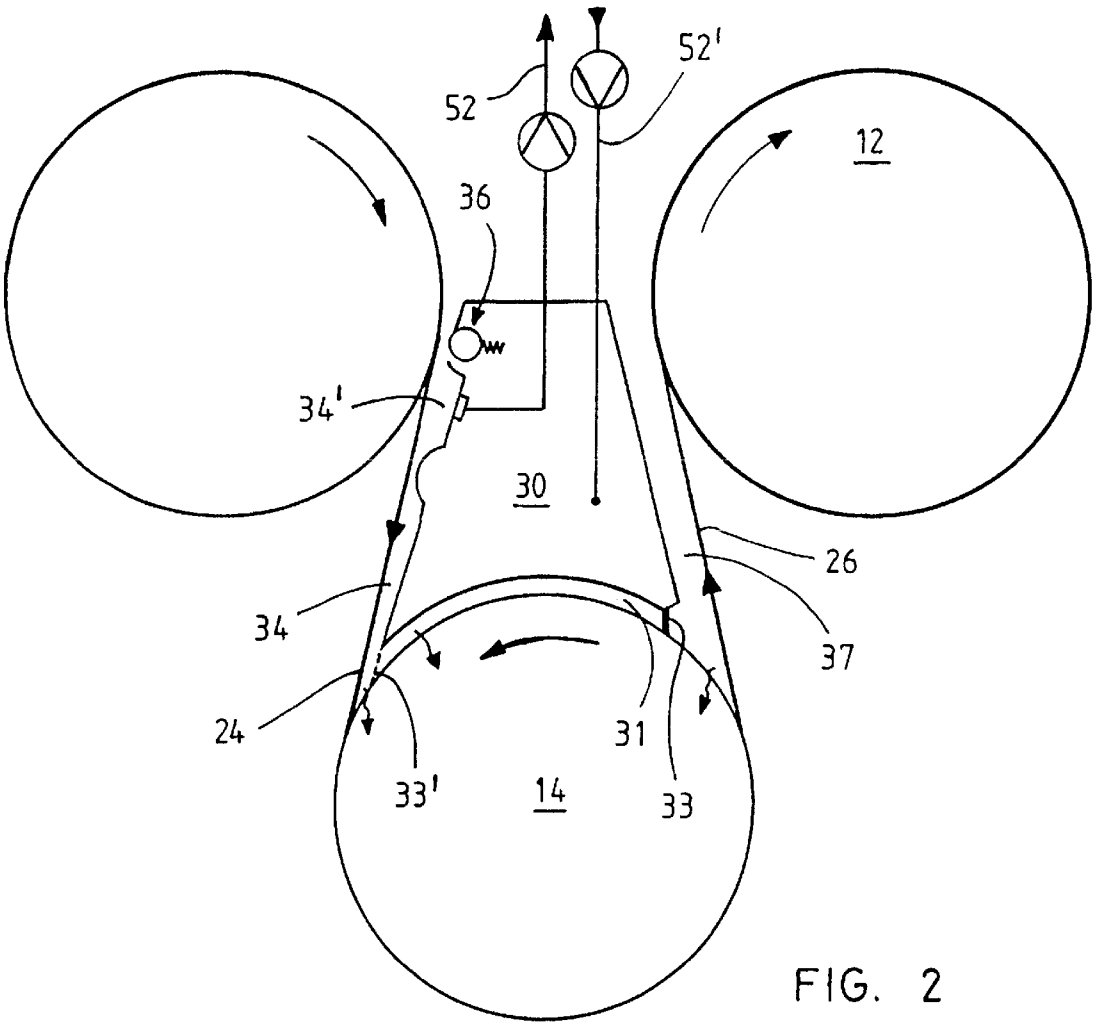
FIG. 2 shows a variation of FIG. 1.

The blow box 30 can be shaped so that it mainly occupies the whole pocket space, i.e. so that the box extends almost from the wire run 24 up to the wire run 26. FIG. 2 shows such a variation of FIG. 1. Then the same reference numerals as in FIG. 1 are used in FIG. 2 when applicable. The lower part of the box 30 in FIG. 2 is widened so that it covers a large part of the periphery of the turn roll 14. In this way the gap 34 between the box 30 and the wire run 24 and the gap 31 between the box 30 and the turn roll 14 can be made so small that they restrict or prevent the air flow. The distance between the box and the roll can be of the order of 10 to 30 mm. Further, the passage of air with the turn roll through the gap 31 to the gap 34 on the wire input side is prevented in the case of FIG. 2 with a sealing ledge 33 or the like arranged at the beginning of the gap 31 (as seen in the travel direction of the roll). Then the box does not necessarily require air blowing 44 according to the FIG. 1 in the closing nip between the turn roll 14 and the wire run 24. Also in the case of FIG. 2 it is possible to use, instead of a mechanical seal 33, an ejecting nozzle (not shown) blowing air away from the gap 31, in the same way as the nozzle 44 in FIG. 1, so that it prevents air from flowing into the gap 31 between the roll 14 and the box 30. At the same time this ejecting nozzle would remove air from the gap 31. The air blown and removed by an ejecting nozzle like this could be directed out from the pocket between the box and the cylinder 12 by an air guide along the wall of the box 30.

It is possible to maintain a pressure difference between the gaps 34 and 31 by arranging in addition a sealing member or the like 33' (shown by broken lines) in the box 30 at the closing nip of the wire run 24 shown in FIG. 2.

In the case of FIG. 2 there is neither needed any ejecting nozzle between the box 30 and the second cylinder 12. The gap 37 between the output wire run 26 and the box 30 has typically a width of 20 to 50 mm, but it can be made so that it widens upwards, whereby the air entering the gap is easily removed from there. In the case of FIG. 2 the roll 14 can be a suction roll which sucks air from the gaps 34, 31 and 37.

A separate air discharge via the channel 52 with the aid of a blower can be arranged in the intensified negative pressure region 34' in the box 30. Instead of the channel 52 it is possible to arrange in the box 30 a separate box part (not shown) with negative pressure, through which part air is removed from the intensified negative pressure region. For the ejecting nozzle 36 operating with positive pressure, air is supplied to the box 30 via the channel 52' with the aid of a blower.

Figure 3:
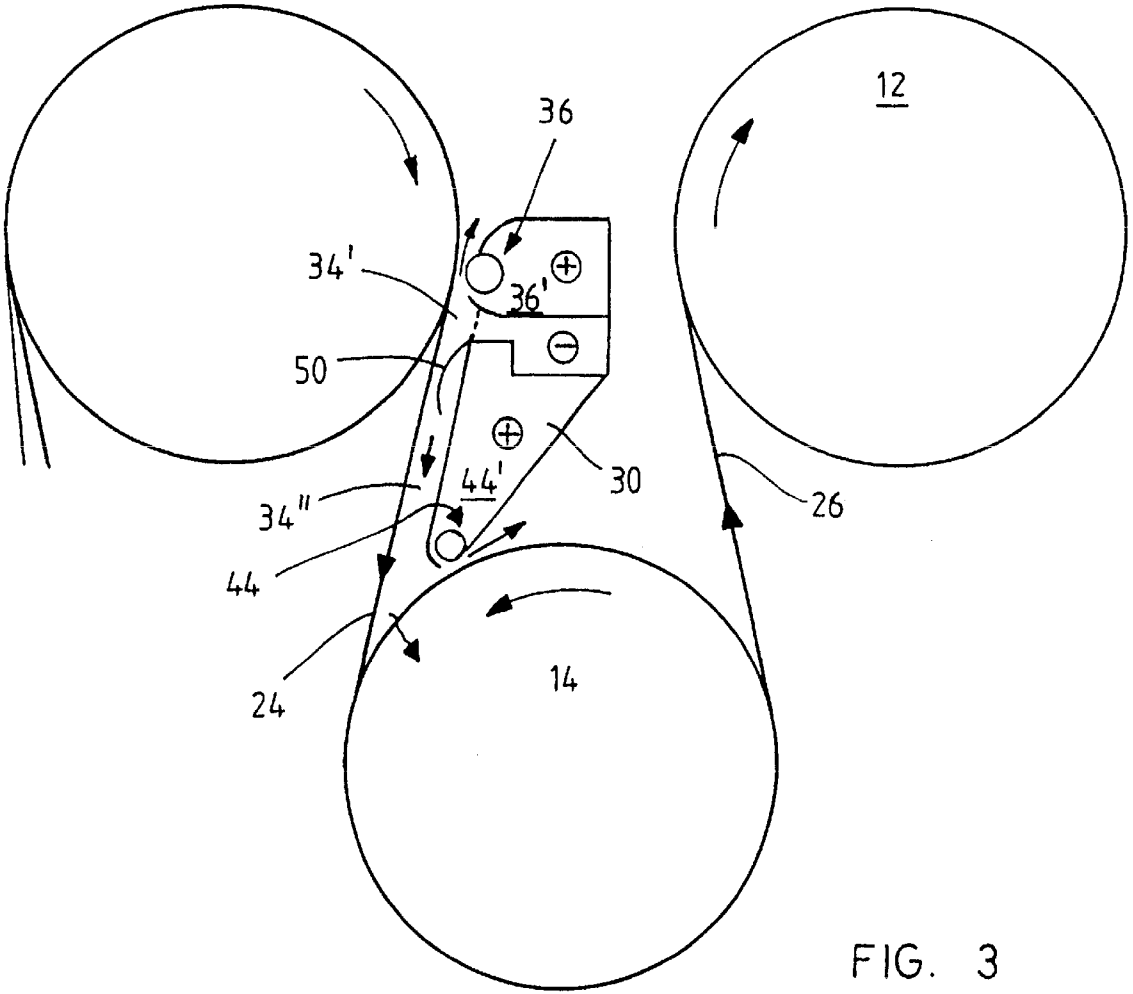
FIG. 3 shows another variation of FIG. 1.

FIG. 3 shows another variation of FIG. 1. The same reference numerals as in FIGS. 1 and 2 are used in FIG. 3 when applicable. The blow box 30 of FIG. 3 is smaller than the box in FIG. 1, and it does not extend the whole distance to the second drying cylinder 12. A box of this kind can be used if it is not necessary to create a negative pressure with the aid of the box at the wire run 26 between the turn roll 14 and the second drying cylinder. The ejecting nozzles 36 and 44 of the box 30 are connected to different blow chambers 36', 44', and they can be controlled individually. The Coanda surface of the ejecting nozzle 44, which is arranged against the curved roll and which removes air from the closing nip between the roll 14 and the wire run 24, acts at the same time as a seal in the gap between the roll 14 and the box 30. A resilient throttling means 50 divides the negative pressure region into two sections 34', 34", where it is possible to maintain different negative pressure levels. The throttling means 50 can be, for instance, similar to the mechanical throttling means shown in FIG. 9. The nozzle 44 can be replaced by a mechanical seal like the means 50, if desired.

Figure 4:
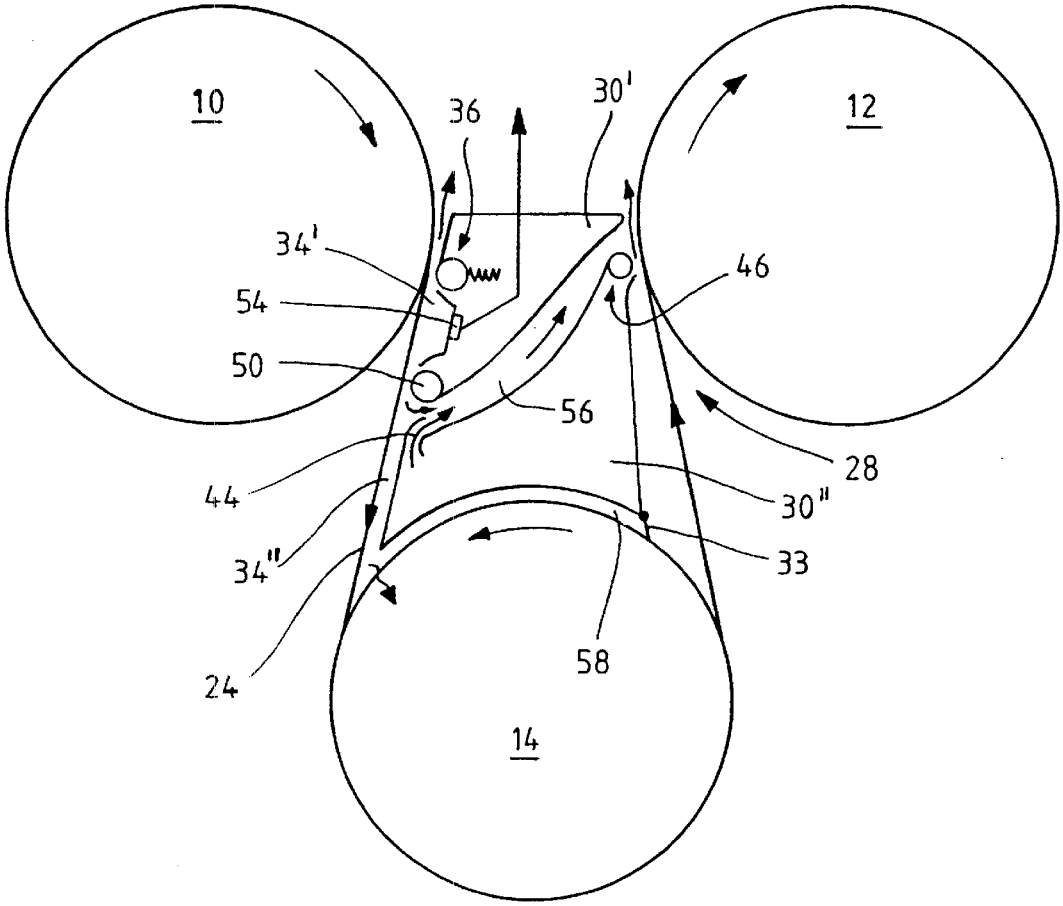
FIG. 4 shows a second blowing device according to the invention in the same way as in FIG. 1.

FIG. 4 shows another blowing device according to the invention in the same way as in the FIG. 1. The same reference numerals as in the previous Figures are used when applicable.

In FIG. 4 the blowing device comprises a two-part blow box combination which is formed by a lower and an upper box section 30', 30". In the upper box section 30' there is arranged an ejecting nozzle 36, a suction opening 54 and a throttling means 50, as in the solution of FIG. 1. However, in the case of FIG. 4 the throttling means 50 is an ejecting nozzle, for instance a nozzle similar to that of the first ejecting nozzle 36, which is arranged to eject air away from the lower part of the gap 34' in order to create an intensified negative pressure in the gap. The ejecting nozzle 50 which creates the seal comprises a convex surface, a so called Coanda surface, along which the ejecting air jets are guided out from the gap 34'. The convex surface guides the ejecting air jets and at least a part of the air which is removed by ejection from the space 34', into the discharge channel 56 formed between the box sections 30', 30" with which the air is discharged from the pocket.

The negative pressure can be maintained in the second, lower section 34" of the gap with the aid of a second nozzle 44, which is arranged in the lower section 30" of the box structure to eject air into the discharge channel 56 and from there further to the space surrounding the drying cylinders. FIG. 4 presents an ejecting nozzle 44 which is a simple gap nozzle and which is arranged at the beginning of the discharge channel 56 to blow air directly into the discharge channel. The air from the nozzle sucks with it air which flows out from the gap 34'.

Figure 4B:
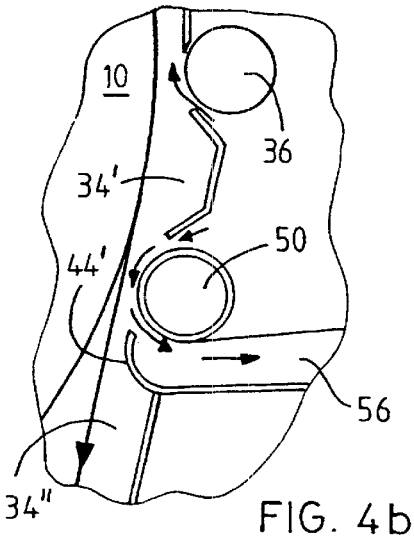
FIG. 4*b* shows a second modification of the solution in FIG. 4.
Figure 4A:
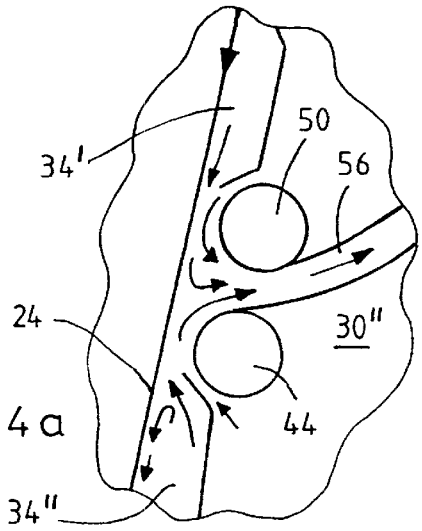
FIG. 4*a* shows in an enlargement a variation of the nozzle 44 of FIG. 4.

FIG. 4*a* shows a first variation of the nozzle 44 in FIG. 4. In the case of FIG. 4*a* an ejecting nozzle provided with a curved surface is arranged close to the wire run 24 in the box structure 30", i.e. the nozzle is similar to the nozzles 36, 46 and 50 in FIG. 4. This nozzle 44 is arranged to blow air through the gap between the nozzle 44 and the wire run toward the discharge channel 56. The air blown with the nozzle 44 prevents the air, which is blown out through the first gap with the aid of the throttling means 50, from flowing into the lower gap 34", and also the air from flowing from the gap 34" upstreams in relation to the wire run. FIG. 4*b* shows a second modification of the solution in FIG. 4. The solution of FIG. 4*b* uses a sealing air guide 44' instead of the ejecting nozzle 44, to prevent air flow between the gaps 34' and 34".

In the solution presented in FIG. 4 there is further arranged an ejecting nozzle 46 in the top part of the lower box structure 30' close to the cylinder 12 and close to the closing nip 28 in order to maintain the negative pressure at the output wire run.

A sealing ledge 33 or the like can be arranged, at the beginning of the gap 58 formed between the turn roll 14 and the bottom surface of the box 30" as seen in the direction of the travelling direction of the roll, so that the ledge prevents or at least reduces the air flow conveyed by the turn roll. Instead of a sealing ledge 33 the sealing can also be provided by shaping the box 30' so that its bottom surface projects very close to the roll. Also in this way it is possible to prevent or at least reduce the air flow between different parts of the pocket. On the other hand, instead of the sealing ledge 33 the sealing can also be provided by an ejecting nozzle, e.g. by replacing the sealing ledge 33 with the nozzle 46 of FIG. 4.

In the solution according to the FIG. 4 a higher or intensified negative pressure is created in the gap 34' between the box 30 and the wire run 24, with the aid of two ejecting nozzles 36 and 50. The intensified negative pressure is typically about 500 to 900 Pa higher than the negative pressure in other parts of the pocket. The nozzle 36 removes air from the gap by ejection, and at the same time it prevents the air conveyed by the wire from flowing into the gap. The nozzle 50 removes also air by ejection. The ejecting air jets further create a protection between the wire and the nozzles preventing them from touching each other, even if the wire would be slightly slackened. The nozzle 46 on the other side of the box ejects air from the pocket space assisting in maintaining a suitable negative pressure level in the pocket.

Figure 5:
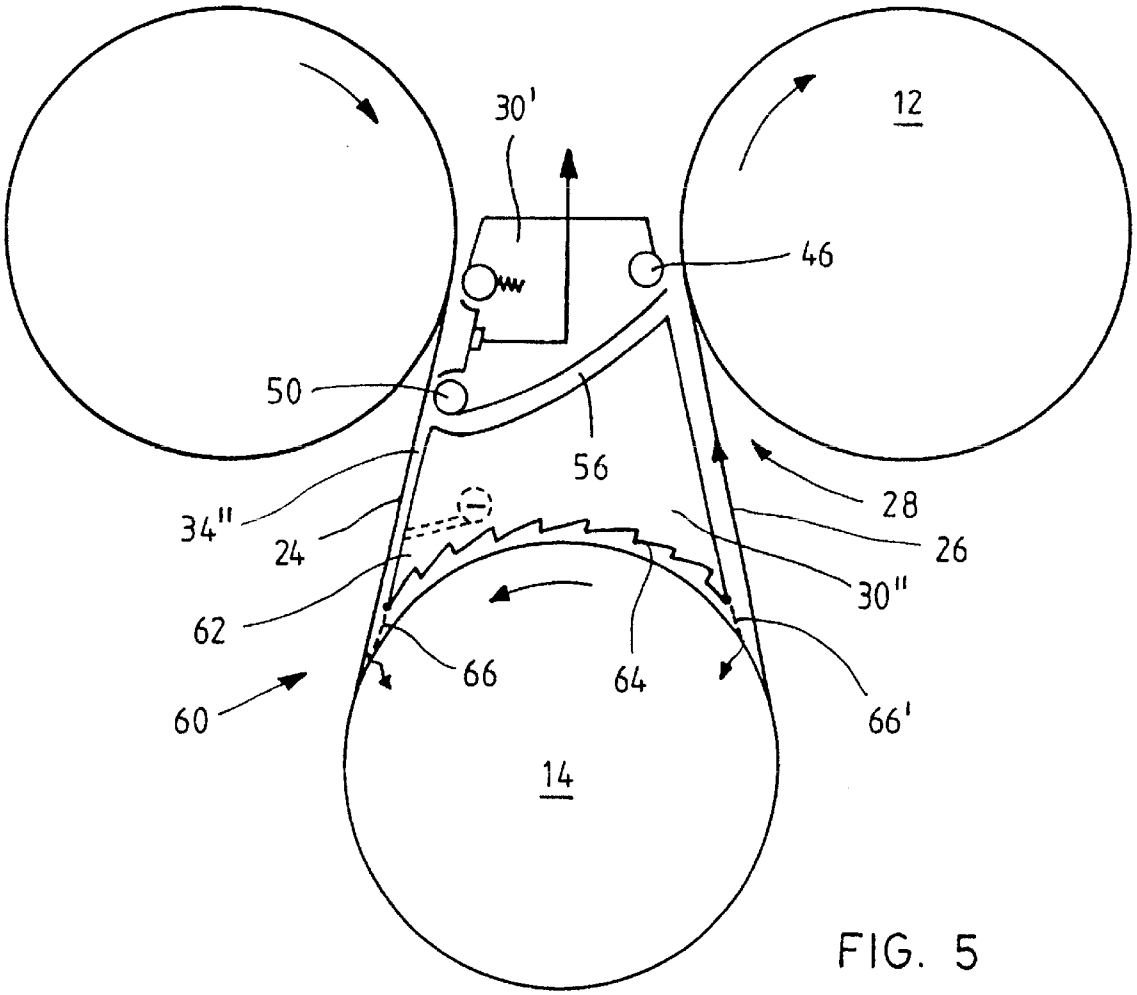
FIG. 5 shows a variation of FIG. 4.

FIG. 5 shows a blow box combination which largely is similar to that of the FIG. 4 and uses the same reference numerals. In the case of FIG. 5 the two-part box structure 30', 30" fills a large part of the pocket, whereby between the box and the wire runs 24, 26 there is left a relatively small region where a negative pressure is to be applied. The box structure has no separate ejecting nozzle 44 to remove air from the gap 34" into the discharge channel 56, as in the case of FIG. 4. In the case of FIG. 5 air is removed from the gap 34" into the turn roll 14 acting as a suction roll, as is the case also in FIG. 4. If desired it is further possible to arrange, in the box section 62 projecting into the closing nip 60 of the turn roll and the wire, a suction opening communicating with means generating the suction, as is shown with the broken lines. More air can be discharged through this closing nip via the suction opening.

Further it is possible to arrange flow preventing means at the lower edge 64 of the box. Blades or plates 66, 66' at the lower edge of the box, and the wave-formed surface of the lower edge form a labyrinth seal between the lower edge of the box and the roll 14, the seal preventing or substantially reducing the air flow in the gap between these.

In the case of FIG. 5 the discharged air in the channel 56 is directed close to the closing nip 28 between the second cylinder 12 and the wire run 26 into the negative pressure space close to the second ejecting nozzle 46. The ejecting nozzle 46 removes the air discharged via the channel 56 from the negative pressure space.

Figure 6:
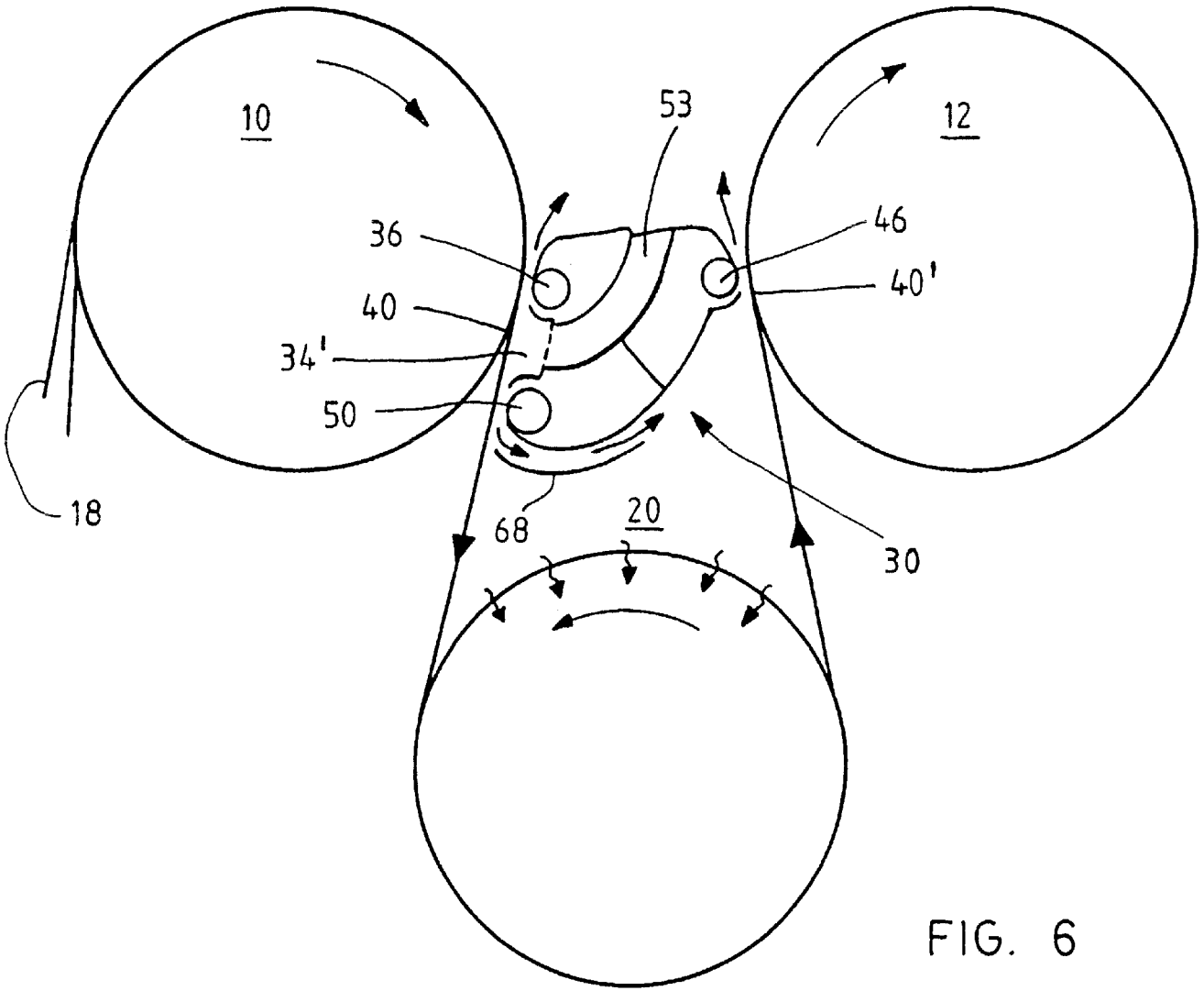
FIG. 6 shows a third blowing device according to the invention in the same way as in FIG. 1.

FIG. 6 shows a third box solution according to the invention using the same reference numerals as in the previous Figures. In this case the box 30 is arranged mainly between on one hand the disengaging point 40 between the first drying cylinder 10 and the wire 18 and on the other hand the engaging point 40' between the second drying cylinder 12 and the wire. The negative pressure in the pocket 20 is generated with the aid of the suction effect of the roll and in addition with the aid of an ejecting nozzle 36 mounted above the disengaging point 40 in the top part of the first side of the box, and with an ejecting nozzle 46 mounted above the engaging point 40' in the upper part of the second side of the box.

A higher negative pressure is created in the intensified negative pressure region with an ejecting nozzle 50 according to the FIG. 4 or 5. The air removed from the gap 34' with the aid of the ejecting nozzle 50 is directed with the aid of the guide plate 68 toward the ejecting nozzle 46 on the other side of the box. In the box there are further arranged means 53 which can create an additional suction or cleaning blow in the gap 34' when required. The use of the suction is possible in the solutions according to the invention because a strong blow with the nozzles 36 against the travelling direction of the wire reduces or completely prevents the passage of dust, paper lint or the like into the suction means.

Figure 7:
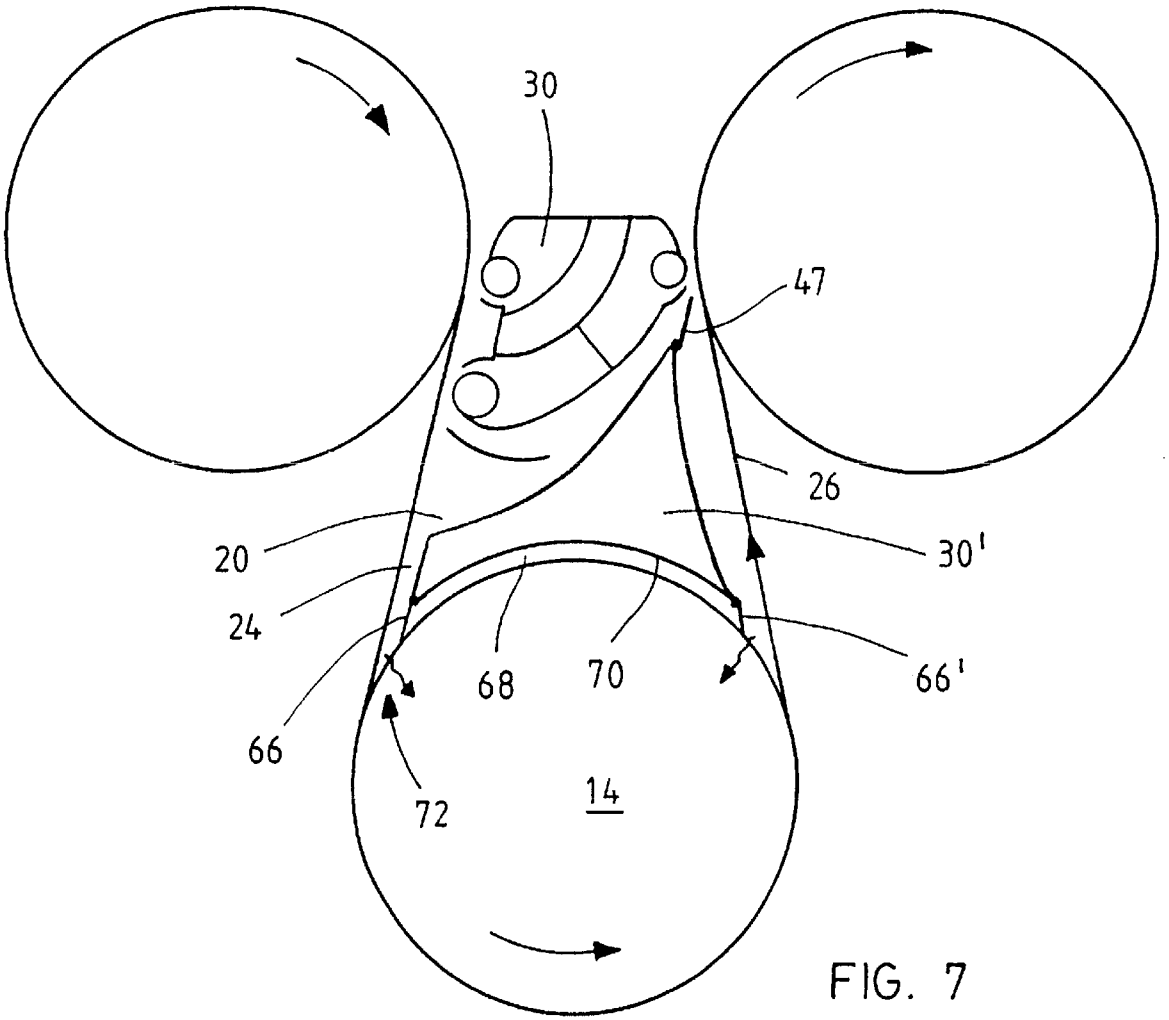
FIG. 7 shows a variation of FIG. 6.

FIG. 7 shows a blow box 30' like that in FIG. 6, but which however is connected to a lower box section 30" having a curved surface 70 mounted in the bottom of it covering a large part of the periphery of the turn roll 14 left within the pocket 20. In the case of FIG. 7 the turn roll is a suction roll which maintains a negative pressure in the pocket in the lower negative pressure region of the pocket. Air is removed from the pocket into the suction roll in the manner shown by the arrows, through those parts 72 of the suction roll's periphery which are not covered by the curved surface of the box. A damper 47 is arranged between the box sections 30', 30", whereby the air flows coming from different sides of the pocket can be controlled by the damper.

The lower box 30" of FIG. 7 can, when required, be a suction box with a width corresponding basically to the whole width of the pocket, which suction box creates a negative pressure in the roll 14. Then there are orifices in the lower part of the suction box 30", and its lower part is curved so that it follows the form of the turn roll 14 so that a narrow space 68 is left between the suction box and the roll. The edges of the space at the wire runs are sealed by mechanical means 66, 66'. When the surface of the turn roll is open, e.g. perforated, the suction box can generate a negative pressure in the turn roll. The turn roll can be arranged to suck air from the gaps between the wire runs 24, 26 and the suction box, so that a required negative pressure, regarding the run of the wire, is formed in the gaps.

Figure 8:
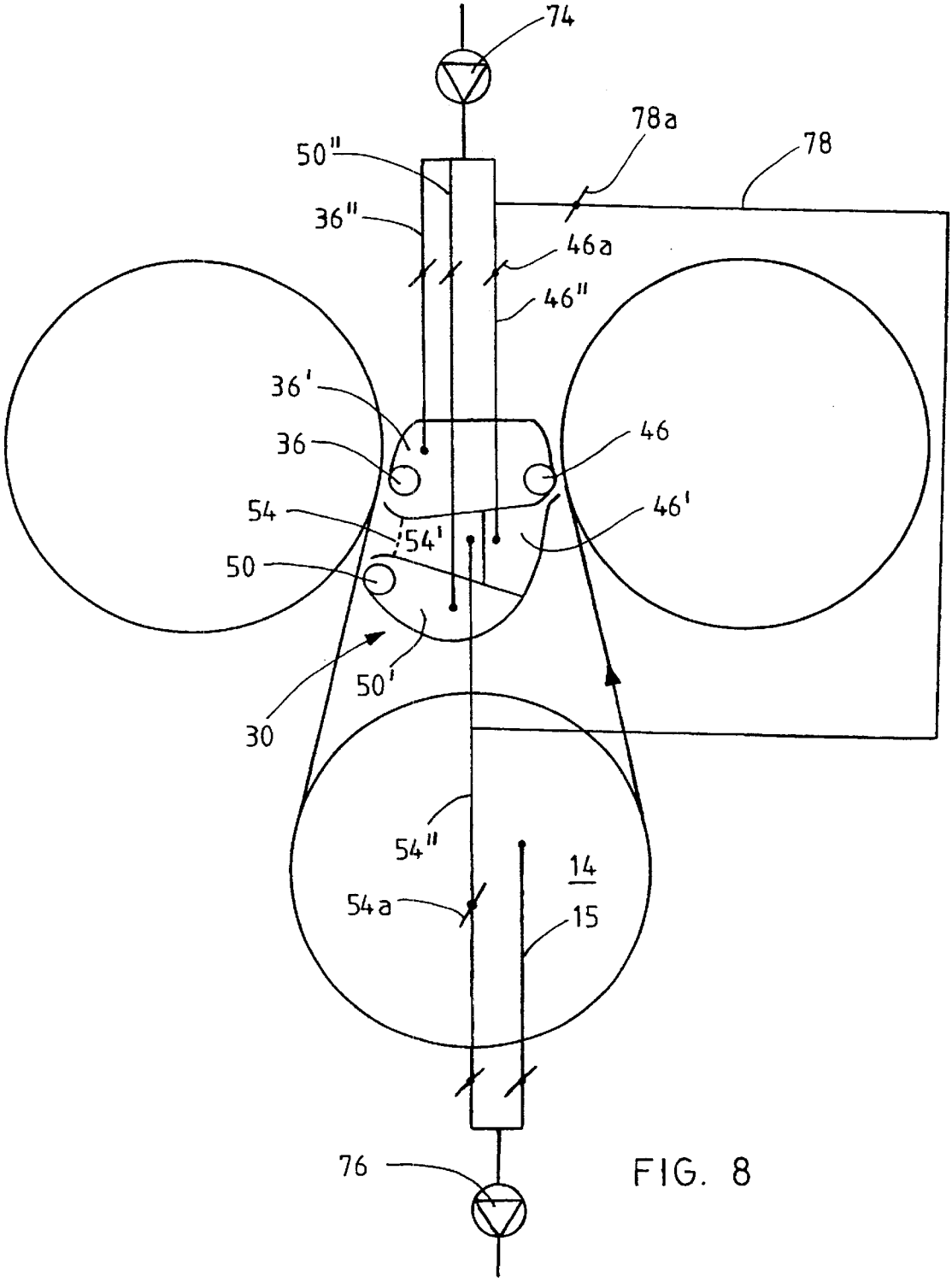
FIG. 8 shows a blowing device similar to that of FIG. 6.

FIG. 8 shows a blow box 30 similar to that of FIG. 6, as well as communicating channels, with which the desired air flows are provided in the nozzles 36, 46, 50 and in the suction opening 54. The air chambers 36', 46' and 50' of the ejecting nozzles 36, 46 and 50 within the boxes are connected to the blower 74 through channels 36", 46" and 50". Some or all of the channels can be provided with control valves for controlling the air jets.

The FIG. 8 further shows a suction chamber 54' communicating with the suction orifice 54, and a channel 54" with which the suction chamber communicates with means 76 creating the suction. The turn roll 14 communicates via the channel 15 with the means 76 creating the suction.

When web breakage occurs the suction from the suction orifice 54 can be closed by closing the valve **54*a* in the channel 54". Instead of the suction a blow may be provided from the suction orifice 54 by closing the valve in the channel 46" and by opening the valve 78*a* in the channel 78, whereby blowing air flows from the blower via the channels 78 and 54" to the suction orifice 54**.

Figure 9:
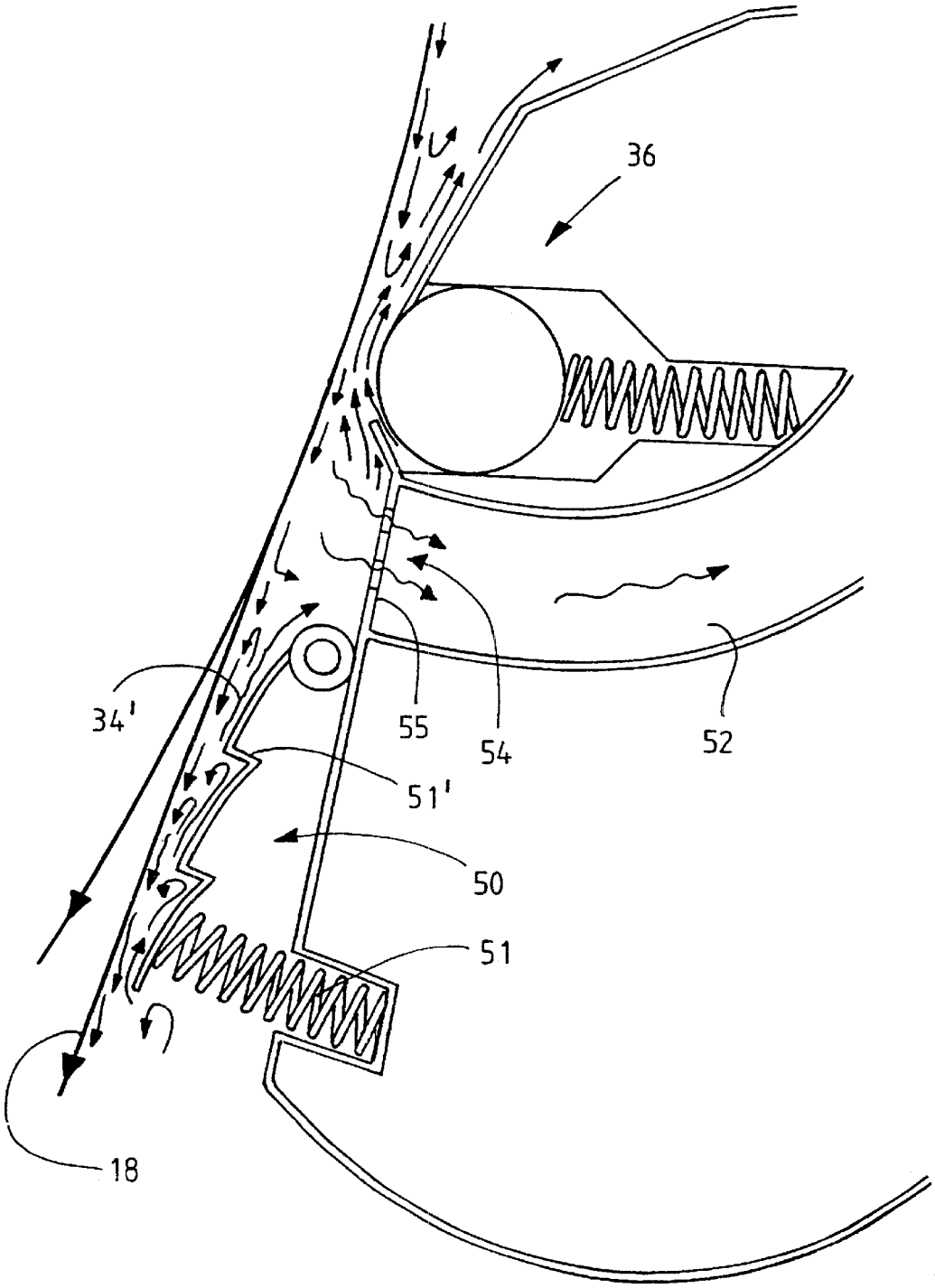
FIG. 9 shows as an example an enlargement of the region with an intensified negative pressure shown in FIG. 6.

FIG. 9 shows an enlargement of the intensified negative pressure region 34' of the type in FIG. 1. Air is ejected away from the region 34' with the ejector 36. Further it is possible to suck air from the region 34' via the suction orifice 54. A net 55 or the like is mounted in front of the suction orifice, the net preventing impurities from reaching the suction channel 52. In this case the mechanical throttling means 50 is a wave-shaped blade or ledge 51' projecting toward the wire 18 with the aid of a spring 51. This blade 51' can have the shape of a smooth arc, i.e. without any wave-form. Several such blades or ledges can be arranged in a row in the gap 34', in order to create a non-continuous pressure difference in the gap.

In FIG. 9 it can be seen how the air flowing out from the ejecting nozzle 36 meets the air flow conveyed with the wire, which then is at least partly deflected. The ejecting air jets draw with them other air from the negative pressure region 34', where the negative pressure is thus intensified. The throttling means 50, which forced by the spring projects relatively close to the wire 18, prevents air from penetrating from the outside of the intensified negative pressure region into the gap 34'. The corrugated surface of the throttling means intensifies this preventive effect as it forms turbulence between the means and the wire. As mentioned above, the throttling means 50 can be an ejecting nozzle, which is e.g. in accordance with the nozzle 36 in FIG. 9, but from which the air flows in the opposite direction, i.e. in the travelling direction of the wire.

Figure 10:
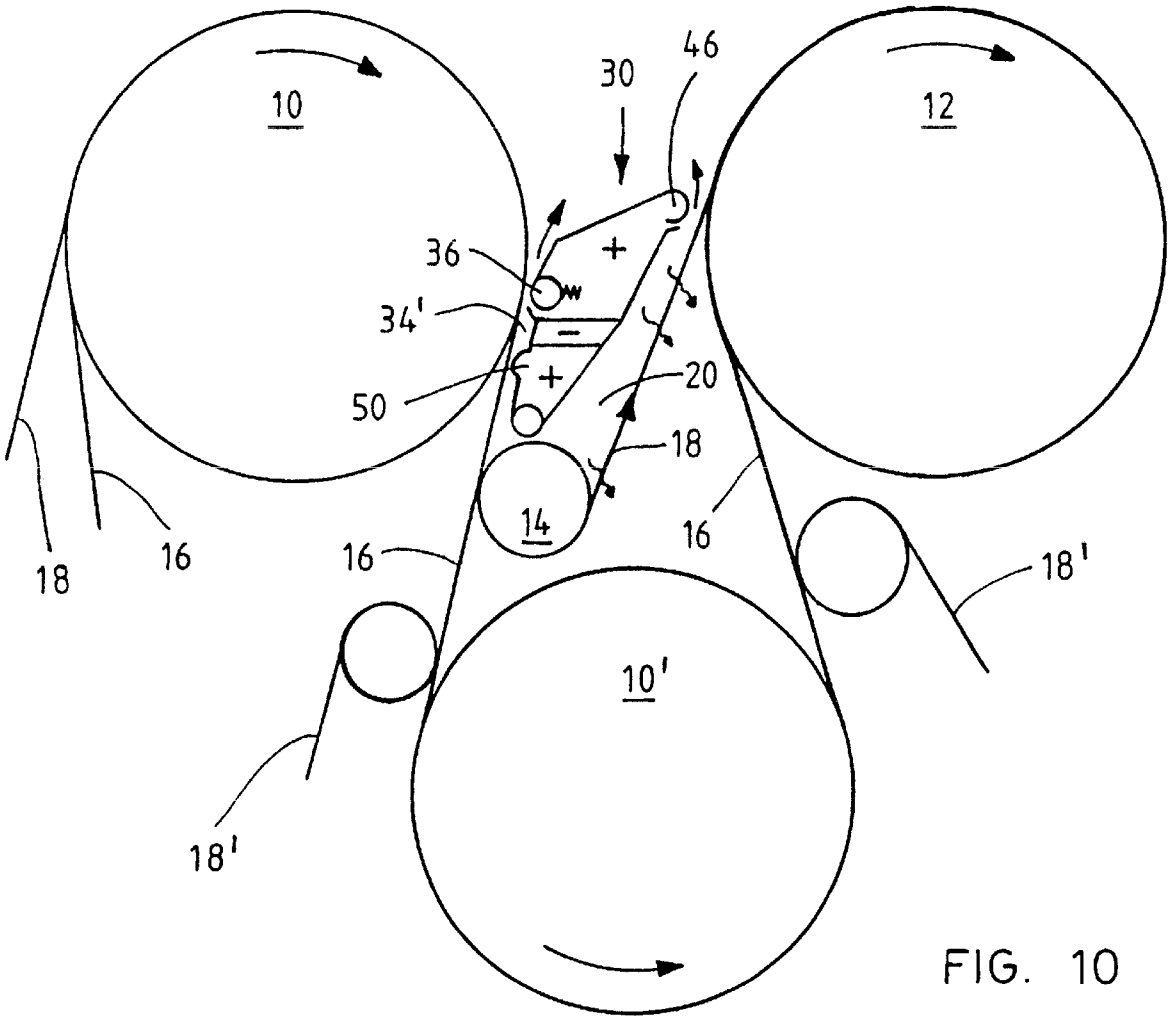
FIG. 10 shows a solution according to the FIG. 3 arranged in a drying section provided with a twin wire run.

In FIG. 10 the solution according to the invention is applied in a drying section provided with a twin wire run. The upper wire 18 of the drying section passes in a winding manner from the first drying cylinder 10 to the second one 12 via the turn roll 14 of the wire. In this way there is formed between the cylinders a pocket 20 defined by the wire and the turn roll. In the pocket there is arranged a blow box 30, which is mainly similar to that of FIG. 3 and in which the ejecting nozzle 36 and the throttle 50 define an intensified negative pressure region 34' at the wire disengaging point. A second blowing nozzle 46 is also arranged in the blow box in order to prevent leaking air from flowing into the pocket space.

A corresponding blow box according to the invention can be used in the drying section shown in FIG. 10, in the region of the lower wire run for disengagement the web 16 from the lower drying cylinder 10' so that it runs on the lower wire 18' over a short distance.

Numerous advantages are achieved with the blow box solution according to the invention. The invention makes it possible to control the negative pressure level at the opening nip according to the machine speed, the dry solids content of the paper and/or the paper quality, whereby the runability of the paper and the efficiency of the drying section can be optimised to a considerably better degree than previously. By controlling the negative pressure level at the intensified negative pressure region it is also often possible to use pulp which has a lower quality than conventionally, e.g. minor amounts of chemical pulp, without having a negative effect on the runability. A part of the fibres may be replaced by filler which is cheaper than fibre. A part of the additives can be replaced by cheaper filler materials. A suitably high negative pressure level will ensure that the web is disengaged from the drying cylinder.

Further advantages of the invention are that:

- the negative pressure level can be increased in only a part of the negative pressure region, and thus it is possible to save energy and expensive structural costs;
- the speed of the paper machine can be increased;
- it is possible to reduce the tension between the press section and the drying section and/or between the drying sections;
- it is possible to increase the temperature of the drying cylinders;
- it is possible to use a lower dry solids content in the web after the press;
- it is possible to use larger drying cylinder groups;
- it is possible to use a high negative pressure level in only a small part of the pocket, which reduces the bending of the wire in the pocket; and/or
- it is possible to use threading with the full width.

When required, the negative pressure regions can, of course, be sealed also in the transversal direction of the web, e.g. with end seals which can be mechanical seals or edge nozzles.

The intensified negative pressure region can extend across the web, or only over a part of the web in its transversal direction. The intensified negative pressure region can be arranged e.g. only at the edge regions of the web, or only on the front side in the threading region. In addition to the control of the negative pressure in the intensified negative pressure region according to the running conditions, it is possible to control it differently at different locations of the web in its transversal direction.

The invention is not intended to be limited to the presented exemplary applications. On the contrary, the invention is intended to be applied within the limits defined in the claims presented below.

Thus, it is conceivable that the invention is applied also in other drying sections than in drying sections provided with a single wire run. It is possible to apply the invention, when desired, also in other parts of a paper machine where the web must be disengaged from a roll or the like and conveyed forward supported by a wire or the like within a negative pressure space, in which it is difficult to increase the negative pressure level.

What is claimed is:

1. A blowing device in a paper or board machine or a finishing machine of the type comprising:

a web and a support fabric conveyed over a first cylinder;

a turn roll positioned downstream of the first cylinder, turning the support fabric at a distance from the first cylinder;

wherein the web is positioned between the support fabric and the first cylinder, the support fabric forming an opening nip, as the web backed by the support fabric leaves the first cylinder, the web and support fabric extending towards the turn roll and at least the support fabric wrapping around the turn roll;

a first blow box connected to a blower extending across the whole width of the web, the first blow box arranged on a side of the support fabric which faces away from the first cylinder, the first blow box extending from the opening nip at least a short distance downstream in the travel direction of the support fabric, the first blow box having at least a first sealing member and a second sealing member which are positioned transverse to the direction of travel of the web;

the first sealing member being a first nozzle which is arranged in the first blow box close to the support fabric at or above the opening nip, the first nozzle blowing air jets away from a gap formed between the support fabric and the first blow box;

the second sealing member is arranged in the first blow box spaced from the first sealing member, whereby the first sealing member and the second sealing member maintain a negative pressure space between the first blow box and the web, the improvement comprising:

in the first blow box spaced from the opening nip there is further arranged a throttling means projecting from the first blow box toward the support fabric, the throttling means dividing the negative pressure space formed between the first and the second sealing members into:

a first intensified negative pressure region bordering the opening nip, and a second lower negative pressure region.

2. The apparatus of claim 1 wherein the second sealing member is a second nozzle.

3. The apparatus of claim 2 wherein the second nozzle of the first blow box is arranged close to a closing nip formed between the turn roll and the wire, so that air jets discharged from the second nozzle suck, with an ejection effect, air away from the closing nip and a space defined between the first blow box and the wire.

4. The apparatus of claim 3, wherein there is arranged in the first blow box between the first nozzle and the throttling means a suction orifice which is connected to a suction device in order to intensify negative pressure in the intensified negative pressure region.

5. The apparatus of claim 2 wherein the first blow box is arranged in a pocket formed between the first cylinder, a second drying cylinder and the turn roll; and between the opening nip between the first cylinder and the support fabric and a closing nip between the second drying cylinder and the fabric, and wherein the second nozzle of the first blow box is arranged close to a closing nip between the second drying cylinder and the support fabric, so that the air jets discharged from the second nozzle suck air, with an ejection effect, away from a pocket formed by the closing nip.

6. The apparatus of claim 5, wherein there is arranged in the first blow box between the first nozzle and the throttling means a suction orifice which is connected to a suction device in order to increase the negative pressure in the intensified negative pressure region.

7. The apparatus of claim 1, wherein the throttling means comprises an ejecting nozzle being arranged in the first blow box and projecting toward the support fabric, the ejecting nozzle being arranged to eject with the aid of air jets, air away from the intensified negative pressure region.

8. The apparatus of claim 7, wherein in the throttling means there is arranged a convex surface which guides the ejecting air jets away from the intensified negative pressure region utilising the Coanda effect.

9. The apparatus of claim 8, wherein a guide plate is arranged between the throttling means and a closing nip between the turn roll and the support fabric, to prevent the air ejected away with the aid of the ejecting nozzle from reaching said closing nip.

10. The apparatus of claim 1, wherein the throttling means comprises a mechanical scaling means for restricting the air flow, which means extends across the web and is mounted resiliently in the first blow box in order to maintain an intensified negative pressure in the intensified negative pressure region.

11. The apparatus of claim 10, wherein the throttling means has a surface which is directed against the support fabric and which is wave-formed.

12. The apparatus of claim 1, wherein the first nozzle and the throttling means are integrated in a common structure covering the intensified negative pressure region, which structure is resiliently arranged at a small distance from the support fabric at the opening nip.

13. The apparatus of claim 1, wherein the throttling means is arranged to extend to a distance which is 2 to 40 mm from the support fabric.

14. The apparatus of claim 1, wherein the length of the intensified negative pressure region between the first nozzle and the throttling means is about 50 to 500 mm in the travel direction of the support fabric.

15. The apparatus of claim 1, wherein the first nozzle is arranged at a distance of about 40 to 150 mm upstream from the disengaging point of the support fabric, and that the throttling means is arranged at a distance of about 40 to 250 mm downstream from the disengaging point of the support fabric.

16. The apparatus of claim 1 further comprising:

a second cylinder spaced from the first cylinder, and wherein the turn roll is a suction roll and is positioned between the first cylinder and the second cylinder;

wherein the blow box has a first blow box section, and a second blow box section is positioned downstream of the first blow box section;

a pocket formed between the first cylinder and the second cylinder and the turn roll;

a closing nip defined between the second drying cylinder and support fabric;

wherein the first blow box section and the second blow box section are arranged in the pocket, and the first blow box section is arranged so as to cover the opening nip; and wherein the first nozzle and the throttling means are arranged in the first blow box section, the second blow box section is arranged to cover at least a part of a surface bordering the turn roll, and between the first blow box section and the second blow box section there is formed an air discharge channel for directing air which is discharged from the intensified negative pressure region out from the negative pressure space.

17. The apparatus of claim 16, wherein the throttling means comprises an ejecting nozzle provided with a convex output surface and arranged at an end of the first blow box section, the ejection nozzle being arranged to eject out air from the intensified negative pressure region with the aid of air jets, and that an input opening of the air discharge channel is arranged close to the convex output surface of the ejecting nozzle, so that the air passing along the convex surface is guided directly to the air discharge channel due to the Coanda effect.

18. The apparatus of claim 16, wherein a surface of the second blow box section directed toward the turn roll is wave-shaped.

19. The apparatus of claim 16, wherein the second blow box section has a nozzle which is arranged close to the closing nip of the second cylinder.

20. The apparatus of claim 1, wherein the second sealing means is a mechanical means restricting the air flow.

21. A blowing device in a twin wire run dryer section of a paper machine comprising:

a web and a support fabric conveyed over a first drying cylinder;

a second drying cylinder spaced from the first drying cylinder:

a turn roll positioned downstream of the first drying cylinder; and a third drying cylinder spaced from the turn roll, wherein the support fabric wraps the first drying cylinder, the turn roll, and the second drying cylinder, and wherein the web extends from the first drying cylinder to the third drying cylinder and from the third drying cylinder to the second drying cylinder, and wherein the web is positioned between the support fabric and the first drying cylinder, the support fabric forming an opening nip as the web backed by the support fabric leaves the first drying cylinder, the web and support fabric extending towards the turn roll and the support fabric wrapping around the turn roll;

a blow box connected to a blower extending across the whole width of the web, the blow box being arranged in a pocket formed between the first drying cylinder, the second drying cylinder, and the turn roll;

a closing nip defined between the second drying cylinder and the support fabric;

the blow box being arranged on that side of the support fabric which faces away from the first drying cylinder, the blow box extending from the opening nip at least a short distance downstream in the travel direction of the support fabric, the blow box having at least a first sealing member and a second sealing member which are positioned transverse to the direction of travel of the web;

the first sealing member being a first nozzle which is arranged in the blow box close to the support fabric, at or above the opening nip, the first nozzle blowing air jets away from a gap formed between the support fabric and the blow box; and wherein the second sealing member is a second nozzle and is arranged close to the closing nip, so that the air jets discharged from the second nozzle suck air away from the pocket with an ejection effect, and wherein in the blow box spaced from the opening nip there is further arranged a throttling means projecting from the blow box toward the support fabric, the throttling means dividing the negative pressure space formed between the first and the second sealing members into a first intensified negative pressure region bordering the opening nip, and a second lower negative pressure region.

* * * * *

UNITED STATES PATENT AND TRADEMARK OFFICE

CERTIFICATE OF CORRECTION

PATENT NO. : 6,574,884 B1
DATED : June 10, 2003
INVENTOR(S) : Reijo Jokinen

It is certified that error appears in the above-identified patent and that said Letters Patent is hereby corrected as shown below:

Column 15,
Line 42, “scaling” should be -- sealing --

Signed and Sealed this

Seventh Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,574,884 B1
DATED : June 10, 2003
INVENTOR(S) : Reijo Jokinen

It is certified that error appears in the above-identified patent and that said Letters Patent is hereby corrected as shown below:

Title page,
Item [56], FOREIGN PATENT DOCUMENTS, the two character designator for document "94/03675" should be -- WO --

Signed and Sealed this

Second Day of March, 2004

JON W. DUDAS
*Acting Director of the United States Patent and Trademark Office*